US009752858B2

(12) United States Patent
Krauss et al.

(10) Patent No.: US 9,752,858 B2
(45) **Date of Patent: *Sep. 5, 2017**

(54) METHODS OF UTILIZING PROJECTILES

(71) Applicant: Orbital ATK, Inc., Plymouth, MN (US)

(72) Inventors: Otto S. Krauss, Ogden, UT (US); John W. Westbrook, III, Lees Summit, MO (US)

(73) Assignee: Orbital ATK, Inc., Plymouth, MN (US)

( * ) Notice: Subject to any disclaimer, the term of this patent is extended or adjusted under 35 U.S.C. 154(b) by 17 days.

This patent is subject to a terminal disclaimer.

(21) Appl. No.: 15/141,630

(22) Filed: Apr. 28, 2016

(65) Prior Publication Data

US 2016/0238359 A1 Aug. 18, 2016

Related U.S. Application Data

(62) Division of application No. 13/789,147, filed on Mar. 7, 2013, now Pat. No. 9,329,007.

(60) Provisional application No. 61/759,735, filed on Feb. 1, 2013.

(51) Int. Cl.

| | |
|---|---|
| ***F42B 10/38*** | (2006.01) |
| ***F42B 10/32*** | (2006.01) |
| ***F42B 5/02*** | (2006.01) |
| ***F42B 12/00*** | (2006.01) |
| ***F42B 30/00*** | (2006.01) |

(52) U.S. Cl.

CPC ..... *F42B 10/38* (2013.01); *F42B 10/32* (2013.01); *F42B 12/00* (2013.01); *F42B 5/02* (2013.01); *F42B 30/00* (2013.01)

(58) Field of Classification Search

CPC ..... F42B 10/00; F42B 10/32; F42B 10/38; F42B 5/00; F42B 5/02; F42B 12/00; F42B 30/00; F42B 30/02; F42B 30/08

USPC ..... 102/473, 490, 501, 502, 514, 516, 517, 102/211, 212, 215, 216, 218, 293; 244/3.1

See application file for complete search history.

(56) References Cited

U.S. PATENT DOCUMENTS

| | | | | |
|---|---|---|---|---|
| 2,949,550 A | | 8/1960 | Brown | |
| 3,446,464 A | | 5/1969 | Donald | |
| 3,722,415 A | * | 3/1973 | Lunt | F42C 19/06 102/216 |
| 3,886,867 A | * | 6/1975 | Krupen | F42C 11/008 102/207 |

(Continued)

OTHER PUBLICATIONS

Cahn et al., Electroaerodynamics in Supersonic Flow, AIAA Meeting, New-York, Jan. 1968, 1 page.

(Continued)

*Primary Examiner* — James S Bergin
(74) *Attorney, Agent, or Firm* — TraskBritt

(57) ABSTRACT

Charged projectile assemblies include a housing and an electronic assembly configured to produce an electric field about at least a portion of the housing of the projectile. Cartridge assemblies for use with firearms include charged projectiles. Methods of charging a projectile include forming an electric field about at least a portion of a projectile and extending the electric field at least partially between a forward portion of the projectile and an aft portion of the projectile.

20 Claims, 5 Drawing Sheets

(56) References Cited

U.S. PATENT DOCUMENTS

| | | | | |
|---|---|---|---|---|
| 4,972,775 | A * | 11/1990 | Hoyt | F42C 13/003 102/211 |
| 4,991,508 | A * | 2/1991 | Ziemba | F42C 13/04 102/211 |
| 5,157,221 | A * | 10/1992 | Ronn | F42C 19/07 102/216 |
| 5,698,815 | A | 12/1997 | Ragner | |
| 5,962,806 | A | 10/1999 | Coakley et al. | |
| 5,970,876 | A * | 10/1999 | Haglund | F42C 19/07 102/216 |
| 6,247,671 | B1 | 6/2001 | Saeks et al. | |
| 6,802,262 | B1 | 10/2004 | Warnagiris et al. | |
| 7,100,514 | B2 | 9/2006 | LeBourgeois | |
| 7,411,401 | B1 * | 8/2008 | Hull | G01R 29/12 324/457 |
| 7,823,510 | B1 | 11/2010 | Hobart et al. | |
| 7,859,818 | B2 | 12/2010 | Kroll et al. | |
| 8,261,666 | B2 | 9/2012 | Garg | |
| 9,329,007 | B2 * | 5/2016 | Krauss | F42B 10/38 |
| 2007/0200028 | A1 | 8/2007 | Gnemmi et al. | |
| 2011/0214582 | A1 | 9/2011 | Glasser | |
| 2015/0337878 | A1 * | 11/2015 | Schlosser | F42B 10/42 181/213 |

OTHER PUBLICATIONS

Cahn et al., Recent Experiments in Supersonic Regime with Electrostatic Charges, AIAA 3rd Fluid and Plasma Dynamics Conference, Jun. 29-Jul. 1, 1970, 12 pages.

Wall et al., Effects of Pulsed-D.C. Discharge Plasma Actuators in a Separated Low Pressure Turbine Boundary Layer (Postprint), Air Force Research Laboratory Propulsion Directorate Wright-Patterson Air Force Base, 45th AIAA Aerospace Sciences Meeting and Exhibit, Jan. 8-11, 2007, 11 pages.

* cited by examiner

METHODS OF UTILIZING PROJECTILES

CROSS-REFERENCE TO RELATED APPLICATION

This application is a divisional of U.S. patent application Ser. No. 13/789,147, filed Mar. 7, 2013, now U.S. Pat. No. 9,329,007, issued May 3, 2016, and which claims the benefit of the filing date of U.S. Provisional Patent Application No. 61/759,735, filed Feb. 1, 2013, the disclosure of each of which is hereby incorporated herein in its entirety by this reference.

TECHNICAL FIELD

Embodiments of the current disclosure relate generally to projectiles having an electric charge for producing an electric field. In particular, embodiments of the current disclosure generally relate to projectiles capable of producing an electric field with an electric charge in order to reduce the amount of drag experienced by the projectile during flight.

BACKGROUND

When a projectile travels through a fluid (e.g., atmospheric air) during flight, the projectile will experience drag forces that act on the projectile as it travels through the fluid. Types of aerodynamic drag that generally act on a projectile during flight are wave drag (e.g., the drag force resulting from aerodynamic shock waves), skin friction drag (e.g., the friction between the airstream and the surface of the projectile), and base drag (e.g., a vacuum effect at the back of the projectile). These aerodynamic drag forces will reduce the speed of the projectile. For example, in the case of a non-self-propelled projectile, drag will reduce the range and accuracy of the projectile as the drag forces act against the initial energy imparted to the projectile. By way of further example, a significant, and uncontrollable, source of error in the accuracy of a projectile, such as a long-range sniper round, is drag forces that cause the projectile velocity to decrease, which increases the time of flight to a target and also increases the likelihood of the projectile deviating from its intended course during flight. In the case of self-propelled projectiles, drag may reduce the accuracy of the projectile and requires more power to propel the projectile during flight.

With aerodynamic drag forces and, in particular, skin friction drag, the total friction to movement of a body through a gas (e.g., atmospheric air) for a given Reynolds number (Re) depends largely upon the aerodynamic design of the particular body concerned. On a projectile, it is generally desirable to delay the transition from laminar to turbulent airflow along the surface of the projectile as much as possible. At moderate speeds, it may be possible to reduce the amount of turbulent flow by proper aerodynamic design of the projectile. However, at relatively higher speeds, turbulent flow invariably results, with the attendant disadvantages of a sudden increase in drag and decrease in lift that will reduce the accuracy of the projectile. Such effects ultimately reduce the distance the projectile is able to travel, given the initial energy imparted to the projectile, and reduce the overall accuracy of the projectile.

One attempt to reduce sonic waves and aerodynamic drag on an airframe of an aircraft is disclosed in U.S. Pat. No. 3,446,464 to William A. Donald, issued May 27, 1969, the disclosure of which is hereby incorporated herein in its entirety by this reference. As disclosed therein, one or more forward electrodes are applied adjacent the leading edge of a wing or other aerodynamic surface of an aircraft and rearward electrodes are provided on the wing or other aerodynamic surface at a position trailing the leading edge to establish an electric field between the electrodes. The strength and direction of the electric field formed between the electrodes are selected to exert a force on air particles in the electric field leading the air particles from the vicinity of the forward electrodes toward the rearward electrodes. This movement of air particles reduces the buildup of air pressure in front of the leading edge of the wing of the aircraft that results in sonic waves and aerodynamic drag.

Another attempt including projecting electrodes for use with self-propelled vehicles, such as aircraft and space craft, is disclosed in U.S. Pat. No. 2,949,550 to T. T. Brown, issued Aug. 16, 1960, the disclosure of which is hereby incorporated herein in its entirety by this reference.

However, such configurations including electrodes extending from the leading end of an airfoil or other surface of an aircraft or vehicle may not be applicable to other devices that travel through a fluid during flight, such as projectiles, which may be substantially smaller in size and of far different configuration than surfaces of an aircraft. Further, the electronic components disclosed in U.S. Pat. Nos. 2,949,550 and 3,446,464, which are used to create the electric field, may not be applicable to other devices that travel through a fluid during flight.

BRIEF SUMMARY

In some embodiments, the present disclosure includes a charged projectile assembly including a housing and an electronic assembly configured to produce an electric field about at least a portion of the housing of the projectile.

In some embodiments, the charged projectile assembly may include a case having a reactive material disposed therein for imparting an initial velocity to the housing of the projectile.

In additional embodiments, the present disclosure includes a cartridge assembly for use with a firearm. The cartridge assembly includes a case having a reactive material disposed therein and a charged projectile disposed at least partially within the housing. The charged projectile includes a housing and an electronic assembly configured to produce an electric field about at least a portion of the housing of the projectile.

In yet additional embodiments, the present disclosure includes a method of charging a projectile. The method includes forming an electric field about at least a portion of a projectile and extending the electric field at least partially between a forward portion of the projectile and an aft portion of the projectile.

BRIEF DESCRIPTION OF THE SEVERAL VIEWS OF THE DRAWINGS

While the specification concludes with claims particularly pointing out and distinctly claiming that which is regarded as embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular device, material, apparatus, system, or method, but are merely idealized representations that are employed to describe embodiments of the present disclosure. Additionally, elements common between figures may retain the same numerical designation for convenience and clarity.

As used herein the term "projectile" is generally used to refer to a variety of projectile type devices such as, for example, munitions including ammunition, bullets, artillery shells, rocket and missile warheads and other payloads, bombs, and other structures launched into and traveling through the atmosphere. In addition, such projectiles may be launched from a variety of platforms such as, for example, any device equipped for discharging a projectile (e.g., personal firearms, cannons, howitzers, recoilless rifles, etc.), fixed wing aircraft, rotary wing aircraft (e.g., helicopters), ground vehicles (e.g., tanks, armored personnel carriers), naval vessels, and stationary ground locations. In some embodiments, such projectiles may be self-propelled, may be non-self-propelled and have an initial velocity imparted to the projectile by a device for discharging a projectile, or may be propelled by a combination of methods of propulsion. Although embodiments of the present disclosure are discussed below with particular reference to rifle cartridges and bullets, it is noted that the present disclosure may be applied to a wide range of projectiles, such as, for example, larger projectiles as listed above.

Figure 1:
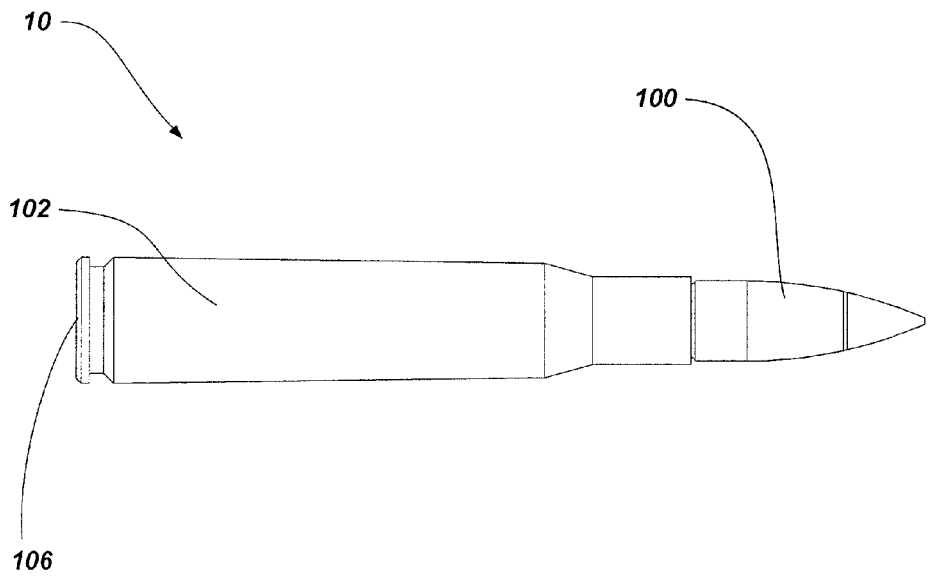
FIG. 1 is a side view of a projectile assembly in accordance with an embodiment of the present disclosure.
Figure 2:
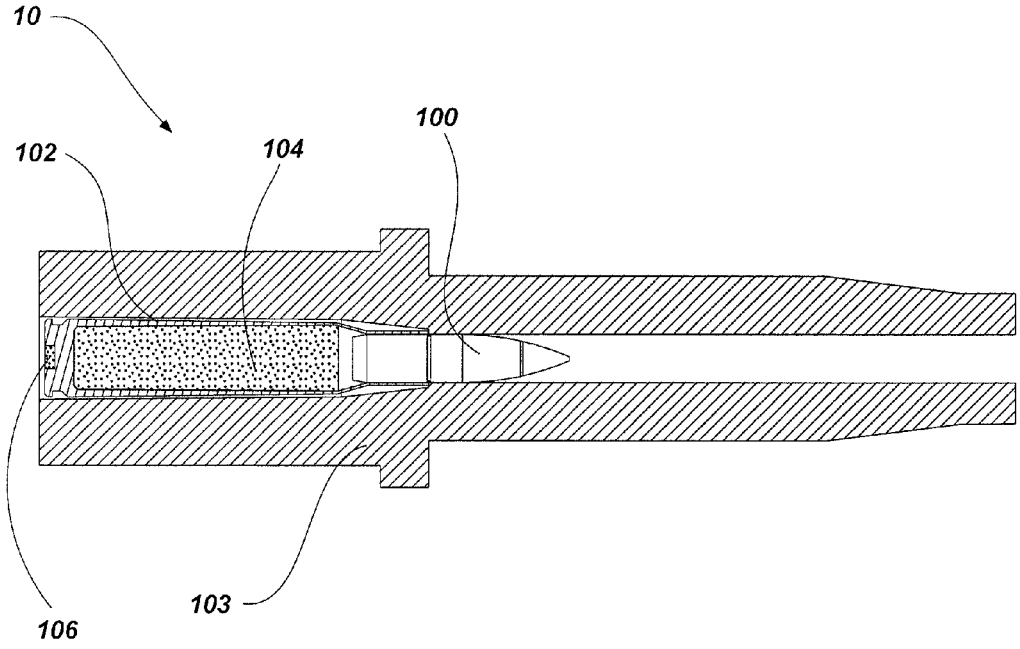
FIG. 2 is a partial cross-sectional side view of the projectile assembly of FIG. 1 including a device for discharging the projectile.

FIG. 1 is a side view of a projectile assembly 10 in accordance with an embodiment of the present disclosure. FIG. 2 is a cross-sectional side view of the projectile assembly 10 of FIG. 1 including a device for discharging a projectile 100. As shown in FIGS. 1 and 2, the projectile assembly 10 includes the projectile 100 in the form of, for example, a bullet that may be initially disposed at least partially within a case 102 (e.g., shell, which may also be characterized as a cartridge casing) that includes a volume of reactive material 104 (e.g., propellant) for imparting an initial velocity to the projectile 100. The case 102 may include an initiator 106 (e.g., primer) for igniting the volume of reactive material 104 in the case 102 to discharge the projectile 100.

In some embodiments, the projectile 100 and case 102 may be loaded in a device 103 for discharging the projectile 100. For example, the device 103 may comprise the barrel of a firearm (e.g., a sniper rifle) and the projectile 100 may comprise a cartridge (e.g., a 7.62×51 mm NATO cartridge, a .308 WINCHESTER® cartridge, a 12.7×99 mm NATO cartridge, and other rifle cartridges of various calibers, such as 5 mm to 40 mm cartridges and larger).

Figure 3:
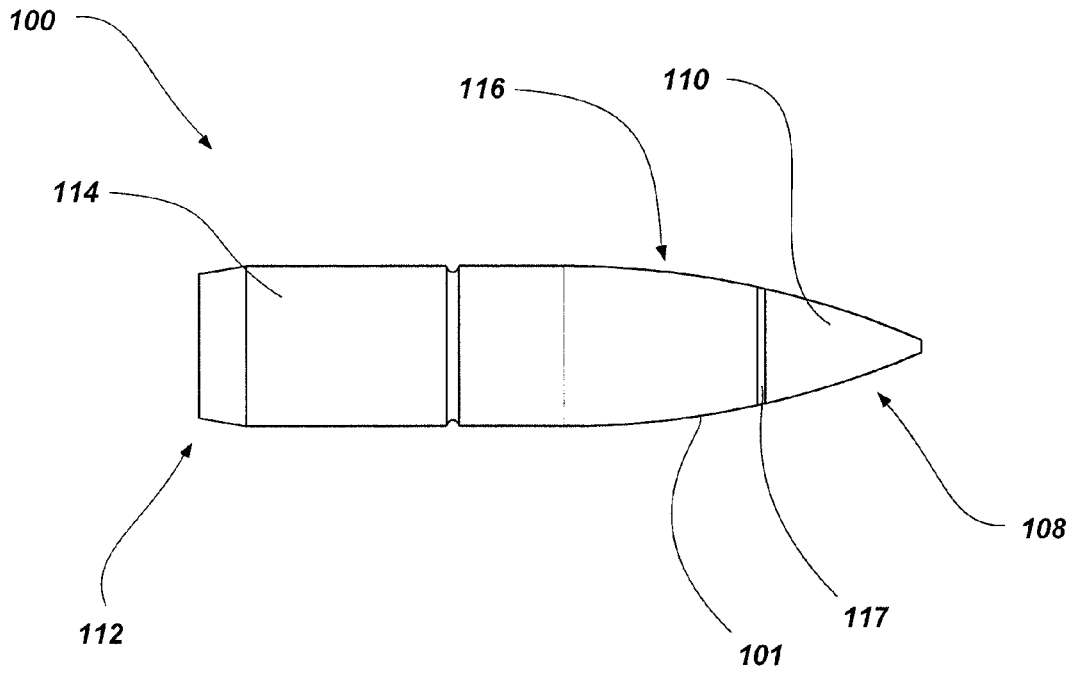
FIG. 3 is a side view of a projectile, such as the projectile shown in FIG. 1, in accordance with an embodiment of the present disclosure.

FIG. 3 is side view of a projectile (e.g., projectile 100 shown in FIG. 1). As shown in FIG. 3, the projectile 100 includes housing 101 having a forward portion 108 including a first electrically conductive region 110 and an aft portion 112 including a second electrically conductive region 114. The first conductive region 110 and the second conductive region 114 are electrically isolated from one another. For example, the projectile 100 may include a middle region 116 comprising an insulative material 117 (e.g., a dielectric) for isolating the first conductive region 110 from the second conductive region 114. In other embodiments, such as that shown in FIG. 4, each of the first conductive region 110 and the second conductive region 114 may be locally isolated from an adjacent portion of the housing 101 of the projectile 100 (e.g., a conductive portion of the housing 101). It is noted that, in some embodiments, the aft portion 112 and the second conductive region 114 may comprise a major portion of the projectile 100. For example, as shown in FIG. 3, the aft portion 112 and the second conductive region 114 may form a majority of the projectile 100 (e.g., 50% to 80% or more of the length of the projectile 100) and may extend to the insulative material 117. In other embodiments, the first conductive region 110 and the forward portion 108 may comprise a major portion of the projectile 100 (50% or greater of the length of the projectile 100).

The first conductive region 110 and the second conductive region 114 of the projectile 100 may form an electric field at least partially surrounding the projectile 100. For example, the first conductive region 110 may comprise a positive charge and the second conductive region 114 may comprise a ground or a negative charge. In such an embodiment, the first conductive region 110 and the second conductive region 114 act as electrical conductors with one or more insulators (e.g., the insulative material 117) positioned between the electrical conductors (e.g., proximate the middle region 116 of the projectile 100) to effectively form a capacitor. As discussed below in further detail, the first conductive region 110 may include (e.g., be coupled to) a power source that applies a voltage to the first conductive region 110. The second conductive region 114 may be negatively charged or may comprise a ground in order to form an electric field extending at least partially between the first conductive region 110 and the second conductive region 114.

In other embodiments, the first conductive region 110 may be negatively charged and the second conductive region 114 may be positively charged in order to form an electric field extending between the first conductive region 110 and the second conductive region 114.

In some embodiments, and as depicted in FIG. 3, the first conductive region 110 and the second conductive region 114 are integral with the surface of the housing 101 of the projectile 100. For example, the first conductive region 110 and the second conductive region 114 may be continuous with the portions of the housing 101 surrounding each of the first conductive region 110 and the second conductive region 114. Stated in another way, the first conductive region 110 and the second conductive region 114 do not protrude from the housing 101 of the projectile 100. Such a configuration provides a projectile 100 having an exterior surface that is substantially similar to an exterior surface of a similarly sized, conventional projectile that lacks electric charging features.

Figure 4:
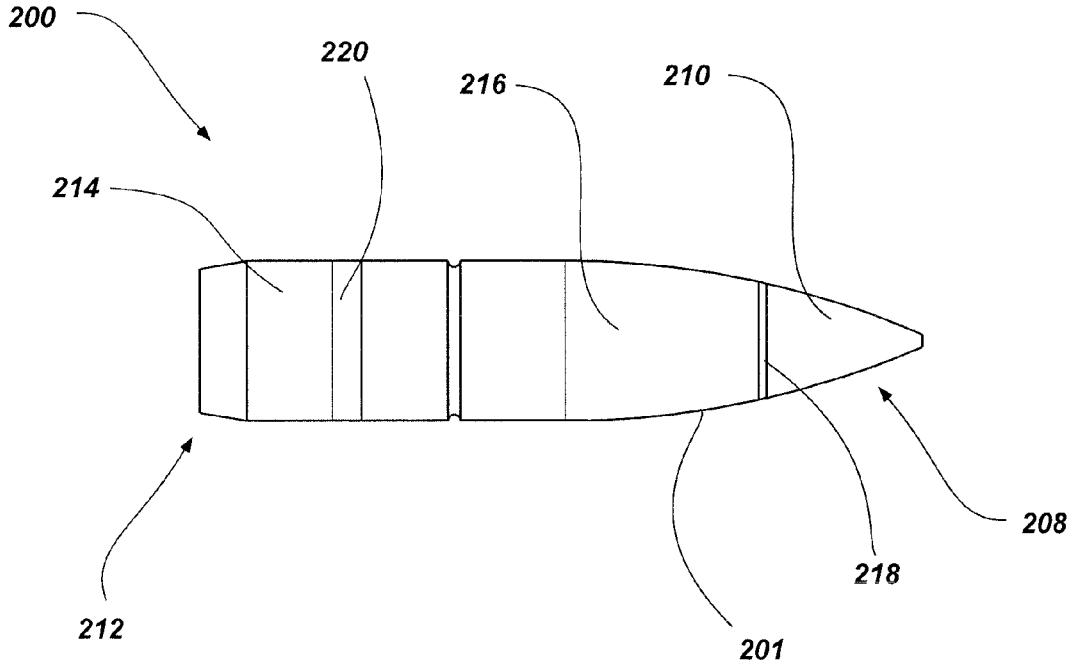
FIG. 4 is a side view of a projectile in accordance with another embodiment of the present disclosure.

FIG. 4 is a side view of a projectile 200 in accordance with another embodiment of the present disclosure. As shown in FIG. 4, projectile 200 may be somewhat similar to the projectile 100 discussed above with reference to FIGS. 1 through 3 and include housing 201 having a forward portion 208 including a first electrically conductive region 210 and an aft portion 212 including a second electrically conductive region 214. The first conductive region 210 and the second conductive region 214 may each be electrically isolated from one another and from a middle region 216 of the housing 201 (e.g., a middle region 216 comprising a conductive material, such as a metal). For example, the projectile 200 may include insulative region 218 positioned between the first electrically conductive region 210 and the middle region 216 of the housing 201 and insulative region 220 positioned between the second electrically conductive region 214 and the middle region 216 of the housing 201.

Figure 5:
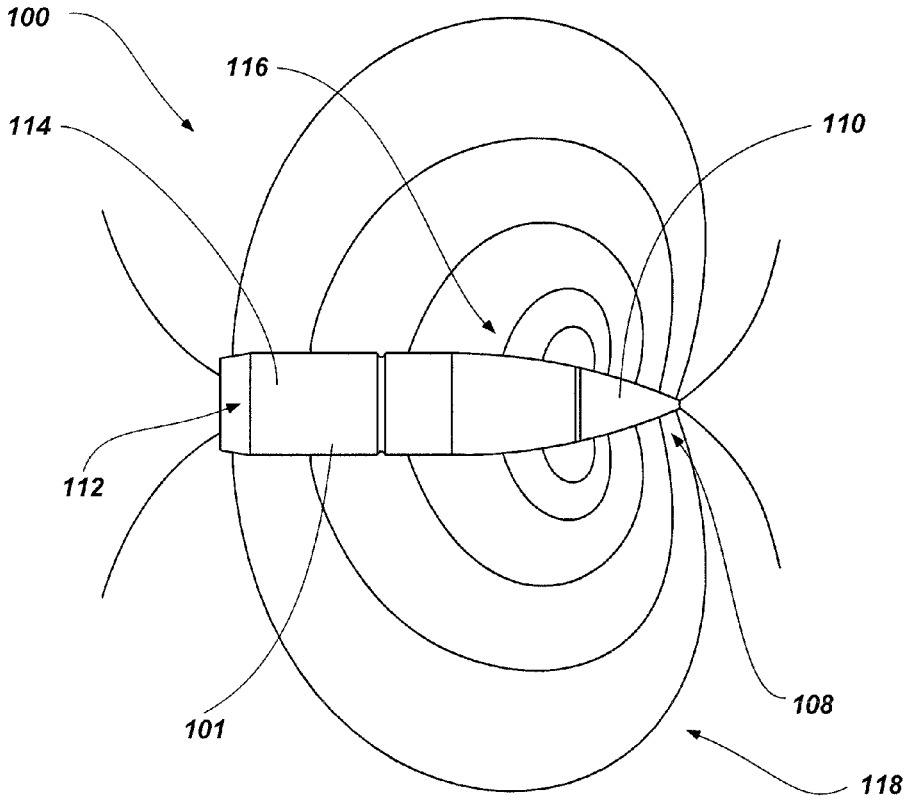
FIG. 5 is a partial side view of a projectile, such as the projectile shown in FIG. 1, in accordance with an embodiment of the present disclosure that is shown producing an idealized graphical representation of an electric field.

FIG. 5 is a partial side view of a projectile (e.g., projectile 100 shown in FIG. 1) with the projectile 100 being shown with an idealized, graphical representation of an electric field 118 that is produced by the projectile 100. As shown in FIG. 5, the electric field 118 is formed by the first conductive region 110 and the second conductive region 114. The electric field 118 extends at least partially between the first conductive region 110 and the second conductive region 114. In some embodiments, and as depicted in FIG. 5, the electric field 118 may extend about a portion (e.g., a majority or entirety) of the forward portion 108 and the first electrically conductive region 110. It is noted that the electric field 118 shown in FIG. 5 is an idealized, graphical representation of an electric field being illustrated herein for clarity and for explaining aspects of the current disclosure and is not intended to be limiting.

Figure 6:
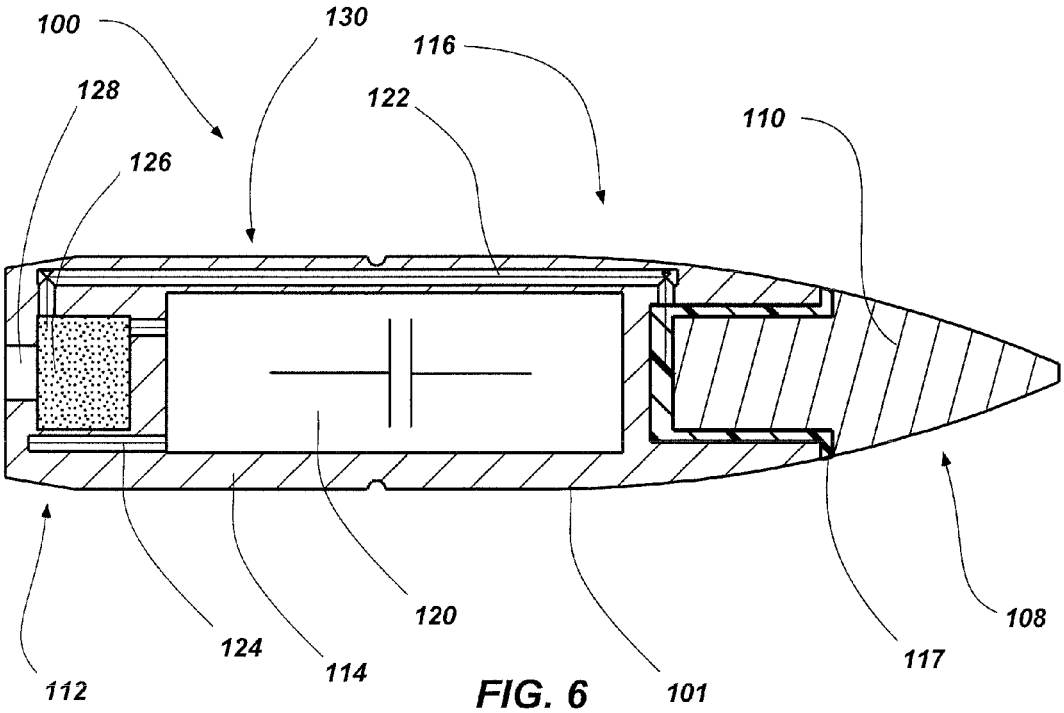
FIG. 6 is a partial cross-sectional side view of a projectile, such as the projectile shown in FIG. 1, in accordance with another embodiment of the present disclosure.

FIG. 6 is a partial cross-sectional side view of a projectile (e.g., projectile 100 shown in FIG. 1). As shown in FIG. 6, the projectile 100 includes an electrical assembly including components (e.g., components within or internal to the projectile 100) that are capable of producing the electric field 118 (FIG. 5). As depicted, the internal components may enable the projectile 100 to self-produce the electric field 118 (e.g., without the use of external components or other electronics after an initial charge is applied to the components). For example, the projectile 100 includes a power source (e.g., a capacitor 120, such as a ceramic capacitor). In some embodiments, the capacitor 120 may comprise a farad-class capacitor capable of accepting around one farad (F) charge (e.g., a tenth of a farad (decifarad) to ten farad (decafarad)).

The capacitor 120 is electrically connected to the projectile 100 to form the electric field 118. For example, the capacitor 120 may be connected to the first conductive region 110 by a first lead 122 and to the second conductive region 114 by a second lead 124.

The capacitor 120 of the projectile 100 may be initially charged to power the electric field 118 (FIG. 5). For example, the capacitor 120 of the projectile 100 may be charged (e.g., directly through a wired connection or indirectly through a wireless electrical connection) during manufacture of the projectile 100. In other embodiments, the capacitor 120 of the projectile 100 may be charged after manufacture of the projectile 100 (e.g., before use of the projectile 100).

In some embodiments, the capacitor 120 of the projectile 100 may exhibit a charge of 0.1 farad or greater and may produce a voltage across the projectile 100 between the first conductive region 110 and the second conductive region 114 of 500 volts to 1 kilovolt or greater (e.g., 5 kilovolts, 6 kilovolts, 7 kilovolts, or greater) for a selected period of time. For example, the projectile 100 may produce a voltage across the first conductive region 110 and the second conductive region 114 for a tenth of a second or less, less than 1 second, or 1 or more seconds until the charge in the capacitor 120 is depleted.

In some embodiments, one or more of the leads 122, 124 may be initially disconnected (e.g., temporarily disconnected) creating an open circuit between the capacitor 120 and at least one of the first conductive region 110 and the second conductive region 114. For example, the projectile 100 may include a switch (e.g., a time delay 126, such as a pyrotechnic time delay or an electronic circuit time delay) that initially inhibits, or later forms, electrical communication between the capacitor 120 and at least one of the first conductive region 110 and the second conductive region 114 via the respective leads 122, 124.

The time delay 126 may enable a circuit 130 of the projectile 100 including the capacitor 120, the first conductive region 110, the second conductive region 114, and the leads 122, 124 to be closed (e.g., at a predetermined time) in order to initiate discharging of the capacitor 120. In some embodiments, the projectile 100 may include a pyrotechnic time delay 126 (e.g., an initiation device) that completes the circuit 130 including the capacitor 120, the first conductive region 110, the second conductive region 114, and the leads 122, 124. For example, the time delay 126 may comprise a pyrotechnic switch that includes a pyrotechnic or combustible material. As known in the art, after ignition of the pyrotechnic or combustible material in the pyrotechnic switch, a contact is made between two points in the switch, thereby closing the circuit 130. The pyrotechnic time delay 126 may be initiated by initiator 128 that is positioned proximate (e.g., adjacent) the pyrotechnic time delay 126 (e.g., at the aft of the projectile 100). In some embodiments, one or more of the pyrotechnic time delay 126 and the initiator 128 may be initiated by the reactive material 104 in the case 102 of the projectile assembly as shown in FIGS. 1 and 2.

In other embodiments, and as mentioned above, the time delay 126 may comprise an electronic time delay circuit.

Where implemented, the time delay 126 may act to delay the formation of the electric field 118 (FIG. 5) by the projectile 100 for a selected amount of time. For example, the time delay 126 may delay the formation of the electric field 118 by the projectile 100 one or more microseconds, one or more milliseconds, or one or more seconds after the projectile 100 is launched into flight.

Figure 7:
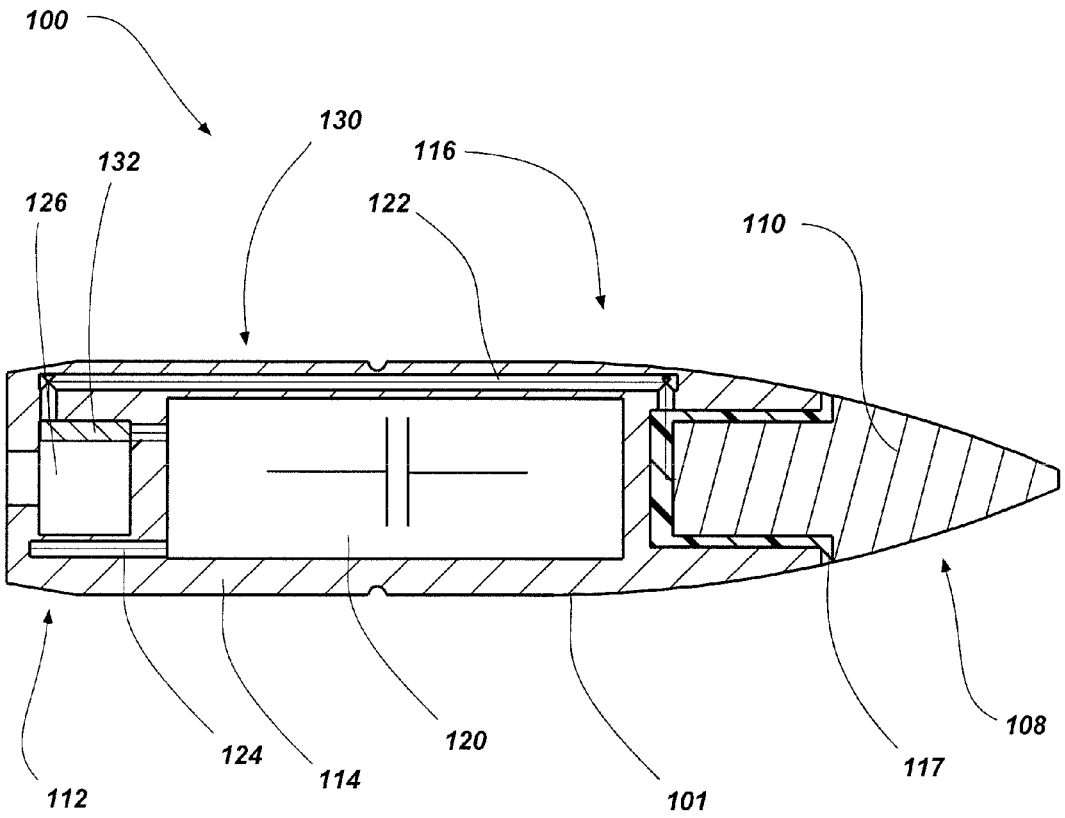
FIG. 7 is a partial cross-sectional side view of the projectile shown in FIG. 6 after a circuit in the projectile has been completed.

FIG. 7 is a partial cross-sectional side view of the projectile 100 shown in FIG. 6 after the circuit 130 in the projectile 100 has been completed (e.g., by the time delay 126). As shown in FIG. 7, the circuit 130 including the capacitor 120, the first conductive region 110, the second conductive region 114, and the leads 122, 124 forms a potential difference across the first conductive region 110 and the second conductive region 114, which are powered by capacitor 120. For example, after the initiation of the time delay 126, the lead 122, which is shown in FIG. 6 as not being in electric communication with the first conductive region 110, now forms an electrical connection (e.g., with contact 132) between the first conductive region 110 and the capacitor 120. A potential difference (voltage) is formed across the first conductive region 110 and the second conductive region 114 by the capacitor 120 (i.e., power source).

As discussed above, the first conductive region 110 (e.g., which may be positively charged by capacitor 120) and the second conductive region 114 (e.g., which may be negatively charged or may comprise a ground) effectively behave as another capacitor to form electric field 118 (FIG. 5) until energy stored in capacitor 120 is depleted.

Figure 8:
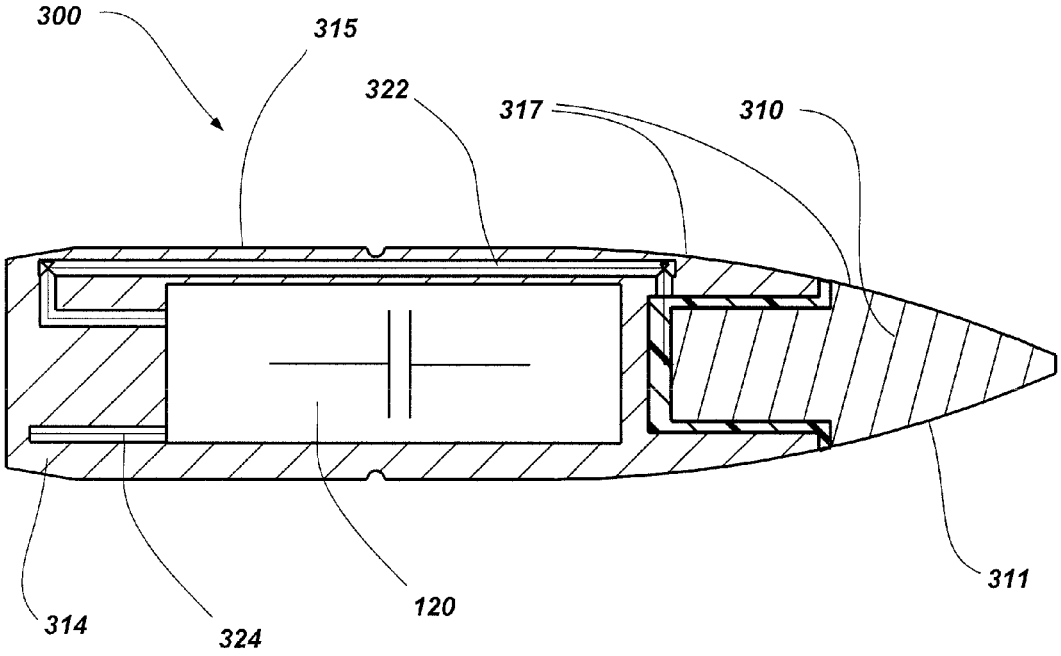
FIG. 8 is a partial cross-sectional side view of a projectile in accordance with yet another embodiment of the present disclosure.

FIG. 8 is a partial cross-sectional side view of a projectile 300 that may be similar to projectiles 100, 200 discussed above with reference to FIGS. 1 through 7. As shown in FIG. 8, a first conductive region 310 and a second conductive region 314 of the projectile 300 may be in electrical connection via leads 322, 324 before the projectile 300 is placed into flight (i.e., the first conductive region 310 and the second conductive region 314 are not initially electrically isolated from one another as above). In such an embodiment, a portion of the projectile 300 may include a dielectric material that substantially prevents the first conductive region 310 and the second conductive region 314 from forming an electric field 118 (FIG. 5) until a selected time. For example, one or more of an external surface 311 of the first conductive region 310 and an external surface 315 of the second conductive region 314 may be coated with a dielectric 317 to isolate the first conductive region 310 and the second conductive region 314 to at least substantially prevent discharging of the capacitor 120. The dielectric 317 may be selected to be at least partially removed during the launch of the projectile 300, thereby causing the projectile 300 to produce the electric field 118 (FIG. 5). For example, if the projectile 300 is fired from a firearm, one or more of the gases in the barrel of the gun and the barrel itself (e.g., the rifling) may act to at least partially remove the dielectric 317 during firing of the projectile 300, thereby causing the now exposed portions of the external surface 311 of the first conductive region 310 and the external surface 315 of the second conductive region 314 to form the electric field 118 (FIG. 5).

Referring to FIGS. 5, 6, and 7, in operation, the projectile 100 may form the electric field 118 before the projectile is in flight (e.g., while the projectile 100 is at zero velocity or stationary), substantially at the time flight begins (e.g., as an initial velocity is applied to the projectile 100), after the projectile 100 is in flight (e.g., through a time delay of the production of the electric field 118), or combinations thereof.

As the projectile travels in flight through a fluid (e.g., atmospheric air), the electric field 118 may act to reduce aerodynamic drag and the buildup of pressure waves (e.g., shock waves) on the projectile 100. In particular, the electric field 118 may tend to exert a force on particles of the fluid (e.g., air particles of the atmospheric air) in the electric field 118 that tends to lead the fluid particles from the vicinity of the forward portion 108 of the projectile 100 toward the aft portion 112 of the projectile 100. This movement of the fluid particles reduces the buildup of pressure waves proximate the forward portion 108 of the projectile 100 (e.g., in a volume in front of (e.g., leading) the projectile 100 in a direction of travel of the projectile 100 in flight). Such pressure waves tend to cause shock waves and aerodynamic drag. The forces exerted on fluid particles by the electric field 118 that moves the fluid particles from the vicinity of the forward portion 108 of the projectile 100 toward the aft portion 112 of the projectile 100 is believed to be attributable to one or both of the electrical effects of electrophoresis and dielectrophoresis.

The effect referred to as electrophoresis arises from the electrostatic attraction of charged electrodes for charged particles. In order to produce this effect, potentials of opposite polarity (e.g., positive and negative or positive and a ground acting as negative) are applied to the first conductive region 110 and the second conductive region 114. Fluid particles in the vicinity of the first conductive region 110 are imparted with an electric charge (e.g., a positive charge) and are then attracted toward the opposite polarity of the second conductive region 114 by electrostatic attraction.

In order to assert a dielectrophoresis effect on the fluid particles, the electric field 118 may be a non-uniform field that will result in movement of the fluid particles from a weaker portion of the electric field 118 toward a stronger portion of the electric field 118. For example, the first conductive region 110 and the second conductive region 114 may be formed to create a stronger portion of the electric field 118 at the aft portion 112 of the projectile 100, thereby drawing the fluid particles toward the aft portion 112 of the projectile 100. By way of further example, the first conductive region 110 may have a smaller surface area than the second conductive region 114 to create a stronger portion of the electric field 118 at the aft portion 112 of the projectile 100.

The forces exerted on fluid particles by the electric field 118 of the projectile 100 are believed to ultimately aid in maintaining a laminar flow regime than a similar projectile lacking such an electric field. For example, the electric field 118 may maintain a laminar flow regime about the projectile 100 at higher speeds than a similar projectile lacking such an electric field. In other words, the electric field 118 may reduce the occurrence of turbulent flow about the projectile 100 or delay transition to a turbulent flow regime about the projectile 100 as compared to a similar projectile lacking such an electric field.

In some embodiments, the electric field 118 of the projectile 100 may substantially maintain a laminar flow regime about the projectile 100 during subsonic speeds and transonic speeds. Stated in another way, the electric field 118 may reduce aerodynamic drag on the projectile 100 as it travels at subsonic speeds, transonic speeds, or even greater speeds with the electric field 118. For example, the electric field 118 may delay the transition from a laminar flow regime to a turbulent flow regime about the projectile 100 as it travels at subsonic speeds, transonic speeds, or even greater speeds. It is further believed the forces exerted on fluid particles by the electric field 118 of the projectile 100 reduce the friction and resultant heating of the surfaces of the projectile 100 that may cause aerodynamic drag and turbulent flow about the projectile 100.

In view of the above, embodiments of the present disclosure may be particularly useful in providing charged projectiles that are capable of producing an electric field that may reduce the amount of aerodynamic drag by maintaining the projectile in a laminar flow regime as compared to a conventional projectile lacking an electric field. Such an electric field may reduce the amount of pressure waves that build up on the fore of the projectile and may also reduce the noise created by a sonic boom. The electric field may also reduce the tendency of the projectile to deviate from a selected path or target due to yawing of the projectile caused at least partially by turbulent flow about the projectile.

As mentioned above, such charged projectiles may be particularly useful in providing ammunition for use with long-range targets (e.g., about 1500 yards or greater (about 1370 meters or greater)). For example and without limitation, such charged projectiles may be used as projectiles to be fired from sniper rifles.

While the present disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure includes all modifications, equivalents, legal equivalents, and alternatives falling within the scope of the disclosure as defined by the following appended claims.

What is claimed is:

1. A method of utilizing a projectile, the method comprising:

forming an electric field about at least a portion of a projectile with a forward conductive portion of the projectile and an aft conductive portion of the projectile; and extending the electric field at least partially between the forward portion of the projectile and the aft portion of the projectile.

2. The method of claim 1, further comprising launching the projectile.

3. The method of claim 2, further comprising initiating the electric field after the projectile is launched.

4. The method of claim 2, further comprising initiating the electric field before or during the launching of the projectile.

5. The method of claim 1, wherein forming an electric field about at least a portion of a projectile comprises discharging a capacitor within the projectile.

6. The method of claim 5, further comprising delaying the discharge of the capacitor within the projectile with a time delay device.

7. A method of utilizing a projectile, the method comprising:

discharging an electrical power source electrically coupled to at least one of a first electrically conductive region proximate a forward portion of a projectile and a second electrically conductive region proximate an aft portion of the projectile; and producing an electric field about the projectile at least partially between the first electrically conductive region and the second electrically conductive region of the projectile.

8. The method of claim 7, further comprising selecting the first electrically conductive region proximate the forward portion of the projectile and the second electrically conductive region proximate the aft portion of the projectile to both be electrically coupled to the electrical power source.

9. The method of claim 8, wherein discharging an electrical power source comprises selectively electrically connecting the electrical power source comprising a capacitor to the first conductive region and the second conductive region.

10. The method of claim 8, wherein discharging an electrical power source comprises applying potentials of opposite polarity to the first conductive region and the second conductive region.

11. The method of claim 7, further comprising delaying the discharging the electrical power source with a time delay.

12. The method of claim 7, further comprising imparting an initial velocity to the projectile with a reactive material disposed in a case associated with the projectile.

13. The method of claim 12, further comprising:

initiating a pyrotechnic time delay with the reactive material within the case; and discharging the electrical power source with the pyrotechnic time delay.

14. The method of claim 7, further comprising firing the projectile with a sniper rifle.

15. A method of utilizing a projectile of a cartridge assembly, the method comprising:

launching a projectile of a cartridge assembly from a case of the cartridge assembly having a reactive material disposed therein; and producing an electric field with an electronic assembly of the cartridge assembly about at least a portion of the projectile between a first electrically conductive region proximate a forward portion of the projectile and a second electrically conductive region during flight of the projectile and before the charged projectile reaches an intended target.

16. The method of claim 15, further comprising producing the electric field after the projectile is separated from the case by the reactive material.

17. The method of claim 15, further comprising initiating production of the electric field with the reactive material within the case.

18. The method of claim 15, further comprising extending the electric field over a dielectric portion of the projectile that separates the first electrically conductive region from the second electrically conductive region.

19. The method of claim 15, further comprising delaying formation of the electric field with a dielectric coating on an exterior portion of projectile.

20. The method of claim 19, further comprising removing the dielectric coating on the exterior portion of projectile during the launching of the projectile.

* * * * *